US009351574B2

(12) United States Patent
Lin

(10) Patent No.: US 9,351,574 B2
(45) Date of Patent: May 31, 2016

(54) LEISURE CHAIR

(71) Applicant: Chang Chen Lin, Tainan (TW)

(72) Inventor: Chang Chen Lin, Tainan (TW)

( * ) Notice: Subject to any disclaimer, the term of this patent is extended or adjusted under 35 U.S.C. 154(b) by 0 days.

(21) Appl. No.: 14/668,954

(22) Filed: Mar. 25, 2015

(65) Prior Publication Data

US 2016/0066692 A1 Mar. 10, 2016

(30) Foreign Application Priority Data

Sep. 9, 2014 (TW) ..... 103216020 U

(51) Int. Cl.
*A47C 1/024* (2006.01)
*A47C 1/0355* (2013.01)
*A47C 7/50* (2006.01)

(52) U.S. Cl.
CPC ..... *A47C 1/024* (2013.01); *A47C 1/0355* (2013.01); *A47C 7/506* (2013.01)

(58) Field of Classification Search
CPC ..... A47C 1/024; A47C 7/506; A47C 1/0355
USPC ..... 297/85 L
See application file for complete search history.

(56) References Cited

U.S. PATENT DOCUMENTS 3,537,747 A * 11/1970 Rogers, Jr. ..... A47C 3/025 297/85 L
3,743,349 A * 7/1973 Crum ..... A47C 1/0345 297/85 L
2012/0112517 A1* 5/2012 Hoffman ..... A47C 1/03272 297/85 L
2012/0248831 A1* 10/2012 Garland ..... A47C 7/506 297/84

* cited by examiner

*Primary Examiner* — Anthony D Barfield

(57) ABSTRACT

A leisure chair includes a backrest pivotably connected to a seat. A connection seat is mounted between a base and the seat and includes a lower coupling portion mounted to the base, an upper coupling portion mounted to the seat, and two pivotal rod units pivotably connected to two sides of the lower coupling portion, respectively. The upper coupling portion is pivotably connected to the pivotal rod units. When a control rod moves rearwards, a push portion on the control rod actuates a pull rod to control a pneumatic rod for adjusting a rearward inclination angle of the backrest. When the control rod moves forwards, a pressing portion of the control rod presses against two swaying rods to extend the legrest unit, and the center of gravity of the upper coupling portion can be located in front of the center of gravity of the base to provide enhanced lying stability.

9 Claims, 8 Drawing Sheets

LEISURE CHAIR

BACKGROUND OF THE INVENTION

The present invention relates to a leisure chair and, more particularly, to a leisure chair including a telescopic legrest and providing enhanced stability in the lying position and use convenience.

A type of chair includes a seat and a backrest having an adjustable rearward inclination angle relative to the seat. Furthermore, a telescopic legrest is mounted to a front end of the seat. When in a sitting position, the rearward inclination angle is small, and the legrest is in a storage position, such that the feet of the user can rest on the ground. The rearward inclination angle can be adjusted to be larger, and the legrest is in an extended position and at a level above the ground, such that the user can lie his or her back on the backrest with his or her legs resting on the legrest, providing a more comfortable lying effect.

The above chair includes a base below or on two sides of the seat. When in the sitting position, the center of gravity of the chair corresponds to the center of gravity of the base. When moved to the lying position, the overall center gravity of the user and the chair greatly shifts rearwards while the center of gravity of the back of the user moves rearwards and the legrest moves forwards to the extended position for supporting the legs of the user. Thus, the chair is apt to tip over. The situation is more dangerous if the area of the base on the ground is small.

Furthermore, adjustment of the rearward inclination angle of the backrest and the telescopic movement of the legrest are controlled by two separate control rods or buttons, leading to an increase in the costs of the components and inconvenient operation.

BRIEF SUMMARY OF THE INVENTION

An objective of the present invention is to provide a leisure chair providing improved support stability when in the lying position.

Another objective of the present invention is to provide a leisure chair including a single control rod to control adjustment of the rearward inclination angle of the backrest and the extending movement of the legrest, increasing operational convenience and reducing the component costs.

A leisure chair according to the present invention includes a base adapted to be placed on a ground. The base includes an upper end having a supporting portion. The base further includes a rear end. A seat is mounted on the upper end of the base. A backrest includes a lower end pivotably connected to the rear end of the seat. The backrest has a rearward inclination angle relative to the seat. The rearward inclination angle is adjustable.

The leisure chair further includes a connection seat mounted between the base and the seat. The connection seat includes a lower coupling portion, two pivotal rod units, and an upper coupling portion. The lower coupling portion is coupled with the supporting portion of the seat. The lower coupling portion includes two sides. A lower coupling plate is provided at each of the two sides of the lower coupling portion and extends in a front/back direction of the seat. Each of the two pivotal rod units is pivotably connected to and movable relative to one of the lower coupling plates. Each of the two pivotal rod units includes a front, vertical pivotal rod substantially extending perpendicularly to the ground, a rear, vertical pivotal rod substantially extending perpendicularly to the ground, and a connecting rod extending in the front/back direction of the seat. The front, vertical pivotal rod of each of the two pivotal rod units has a lower end pivotably connected to a front end of the lower coupling plate. The rear, vertical pivotal rod of each of the two pivotal rod units has a lower end pivotably connected to a rear end of one of the two lower coupling plates. The connecting rod of each of the two pivotal rod units has a rear end pivotably connected to an upper end of one of the rear, vertical pivotal rods. The connecting rod of each of the two pivotal rod units further has a front end located in front of a front end of one of the front, vertical pivotal rods. The upper coupling portion includes two upper coupling plates extending in the front/back direction of the seat. The two upper coupling plates are fixed to the seat. Each of the two upper coupling plates is pivotably connected to the upper end of the front, vertical pivotal rod of one of the two pivotal rod units.

The leisure chair further includes a legrest unit including two link units movable between an extended position and a folded position. Each of the two link units includes a rear end pivotably connected to the front end of one of the upper coupling plates and one of the connecting rods.

The leisure chair further includes an adjusting unit including a driving rod pivotably connected to a rear end of the legrest unit. When the driving rod moves forwards, the two link units move to the extended position, the connecting rods are actuated to move the two pivotal link units, and the upper coupling portion moves forwards relative to the lower coupling portion.

The front end of each of the two upper coupling plates can include two front pivotal portions. The rear end of each of the two link units can include first and second links pivotably connected to the two front pivotal portions, respectively. The first link is located behind the second link and is pivotably connected with the front end of one of the connecting rods.

Each of the two upper coupling plates can include a through-hole. A transverse connecting beam can be coupled in and extend through the through-holes of the two upper coupling plates. A side coupling portion is mounted to an outer side of one of the two upper coupling plates and has an axle. The adjusting unit further includes a control rod, two swaying rods, and two first springs. The control rod includes an upper end having a gripping portion and a lower end having a pivotal portion pivotably connected to the axle of the side coupling portion. The control rod includes a pressing portion above the pivotal portion thereof. Each of the two swaying rods is mounted to the outer side of one of the upper coupling plates. Each of the two swaying rods includes a front end having an engagement hole and a rear end. The transverse connecting beam of the connection seat is securely engaged in the engagement holes of the two swaying rods. The transverse connecting beam and the two swaying rods are jointly moveable. The rear end of each of the two swaying rods is pivotably connected to a rear end of the driving rod. Each of the two swaying rods further includes an intermediate portion having a peg. Each of two first springs has first and second ends. The first end of each of the two first springs is attached to the peg of one of the two swaying rods. The second end of each of the two first springs is attached to a protrusion of one of the two upper coupling plates. An imaginary line extends through the engagement hole of each of the two swaying rods and the protrusion of one of the two upper coupling plates. The rear end of the driving rod is pivotably connected to the two swaying rods. The driving rod further includes a front end pivotably connected to the first link of one of the two link units. When the legrest unit is in the storage position, the pegs of the two swaying rods located above the imaginary lines. When the control rod moves forwards, the pressing portion presses against and actuates the two swaying rods to move, and the legrest unit moves to the extended position under elastic forces provided by the first springs when the pegs of the two swaying rods located below the imaginary lines.

The adjusting unit can further include a second spring attached between the control rod and the side coupling portion.

The leisure chair can further include a transverse rod interconnected between the two front, vertical pivotal rods and a transverse rod interconnected between the two upper coupling plates.

The side coupling portion can include a rear board having an intermediate section with a bend. The bend of the intermediate section of the rear board has an abutment portion. The control rod includes a push portion. The push portion of the control rod abuts the abutment portion to limit a maximum displacement angle of the control rod.

Each of the two lower coupling plates of the connection seat can further include a soft buffering member mounted to an outer side thereof. The rear, vertical pivotal rods abut the soft buffering members during movement of the rear, vertical pivotal rods.

The side coupling portion can include a rear board. The adjusting unit can further include a pneumatic rod and a pull rod. The rear board of the side coupling portion includes a lower end having a guiding hole. The control rod further includes a push portion below the pivotal portion thereof. The pneumatic rod includes a rear end pivotably connected to the backrest and a front end pivotably connected to the seat. The pneumatic rod further includes a control cable extending through the guiding hole of the side coupling portion. The pull rod includes an upper end pivotably connected to the axle and a lower end coupled to an end of the pneumatic rod. When the control rod moves rearwards, the push portion actuates the pull rod to move and pull the control cable of the pneumatic rod.

The adjusting unit can further include a third spring having two ends respectively attached to the rear board of the side coupling portion and the pull rod. When the pull rod moves, the third spring is tensioned for returning the pull rod.

The present invention will become clearer in light of the following detailed description of illustrative embodiments of this invention described in connection with the drawings.

DETAILED DESCRIPTION OF THE INVENTION

Figure 1:
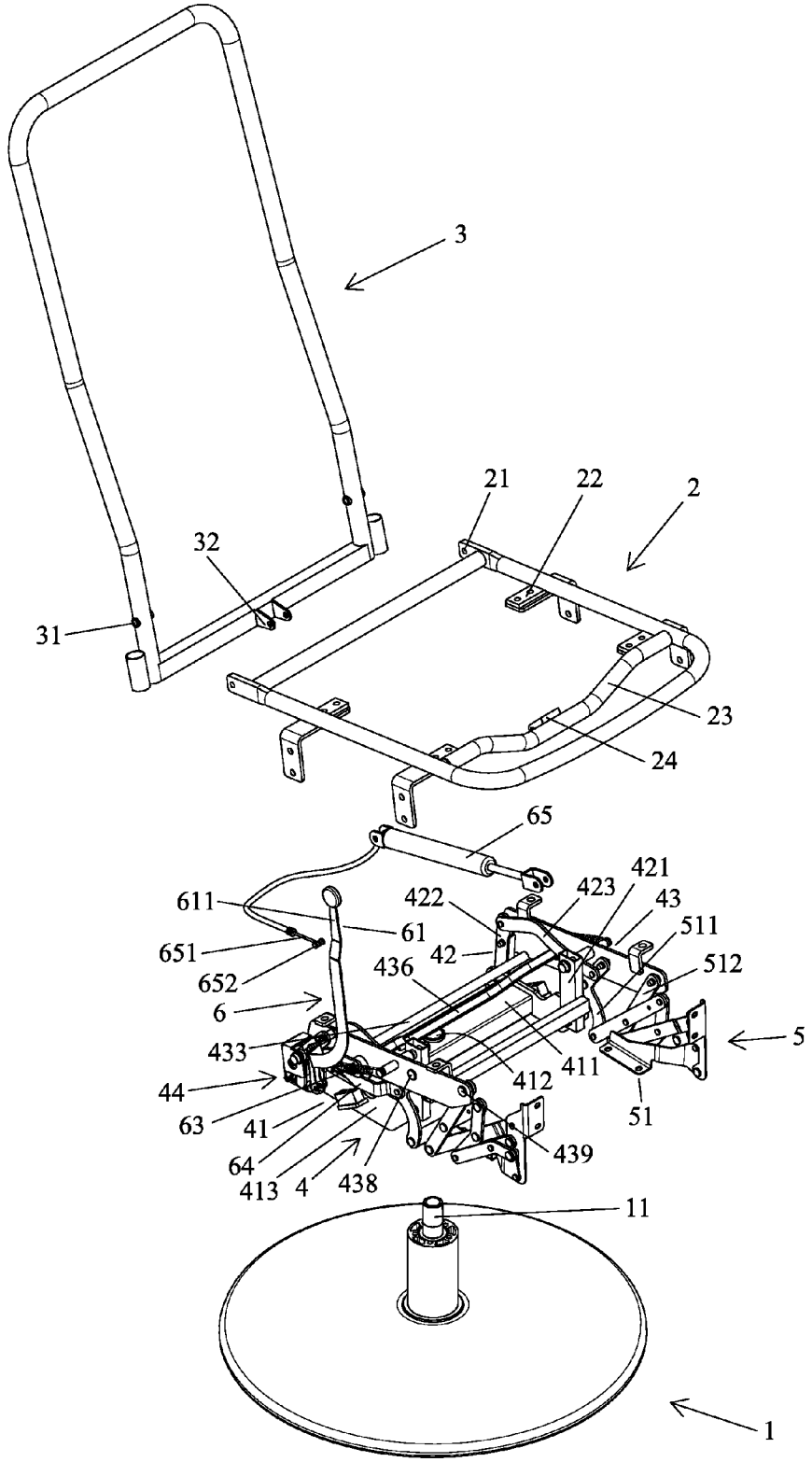
FIG. 1 is an exploded, perspective view of a chair according to the present invention.
Figure 2:
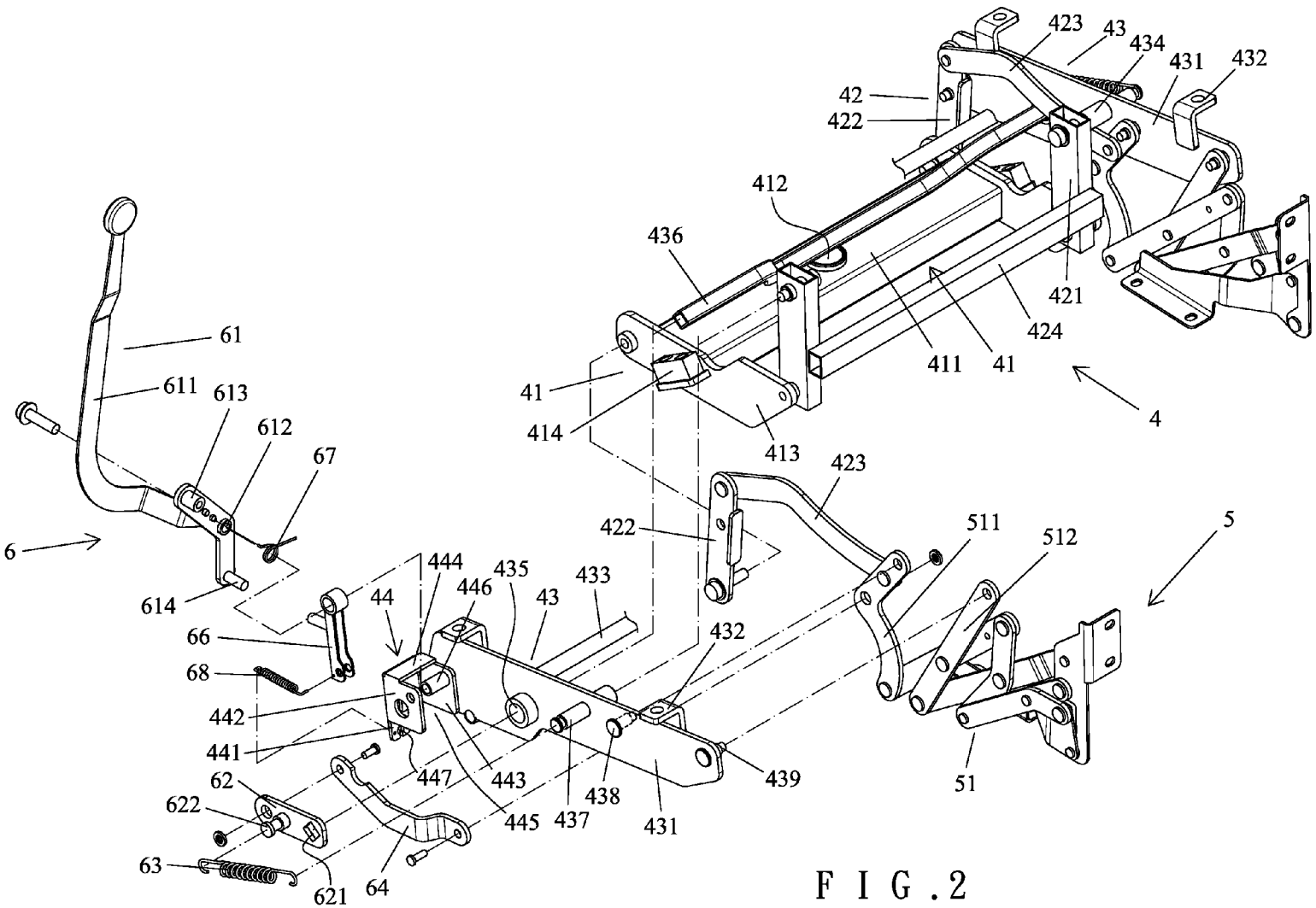
FIG. 2 is a partial, exploded, perspective view of the chair according to the present invention.
Figure 3:
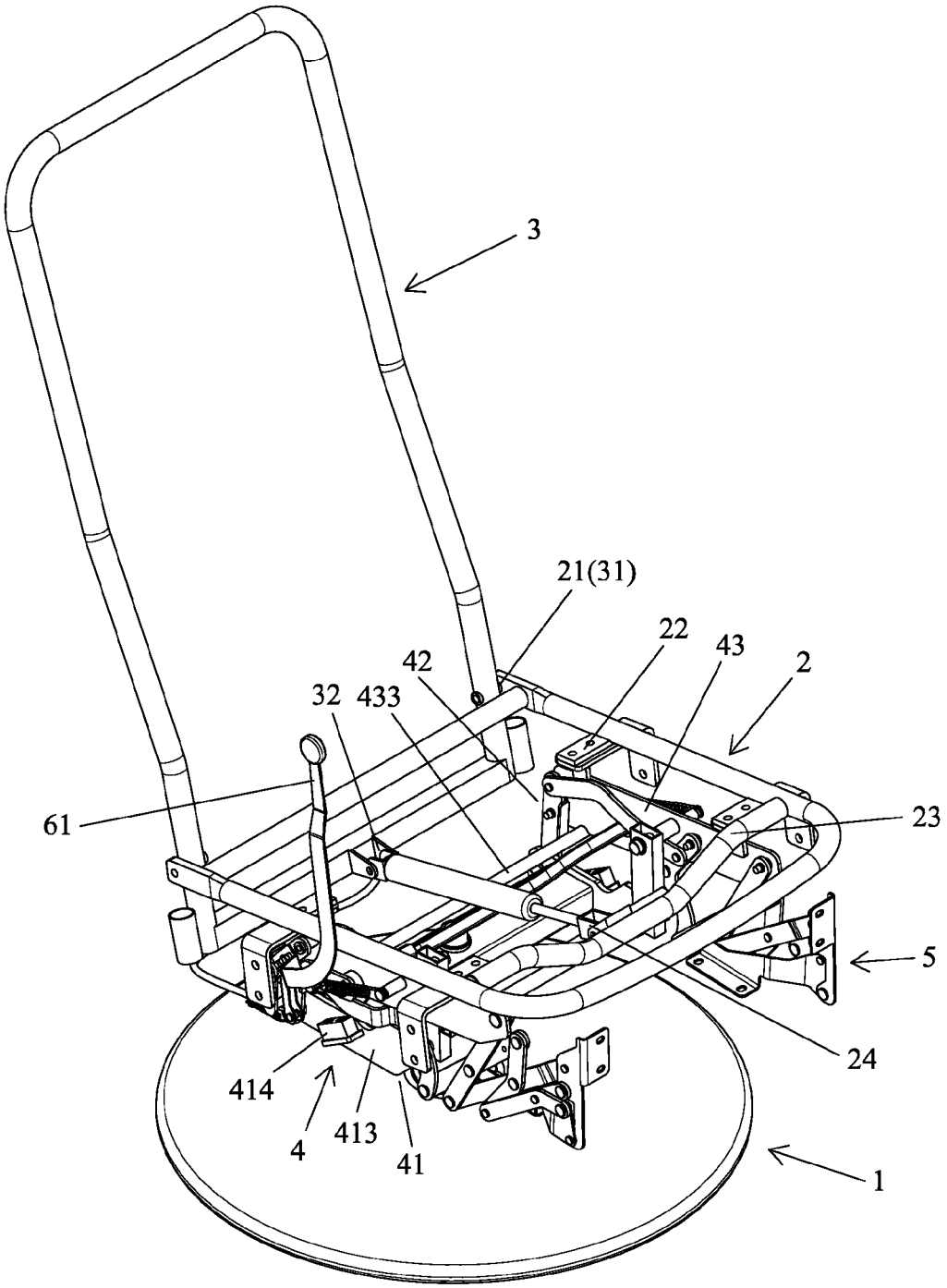
FIG. 3 is a perspective view of the chair according to the present invention in a sitting position.
Figure 4:
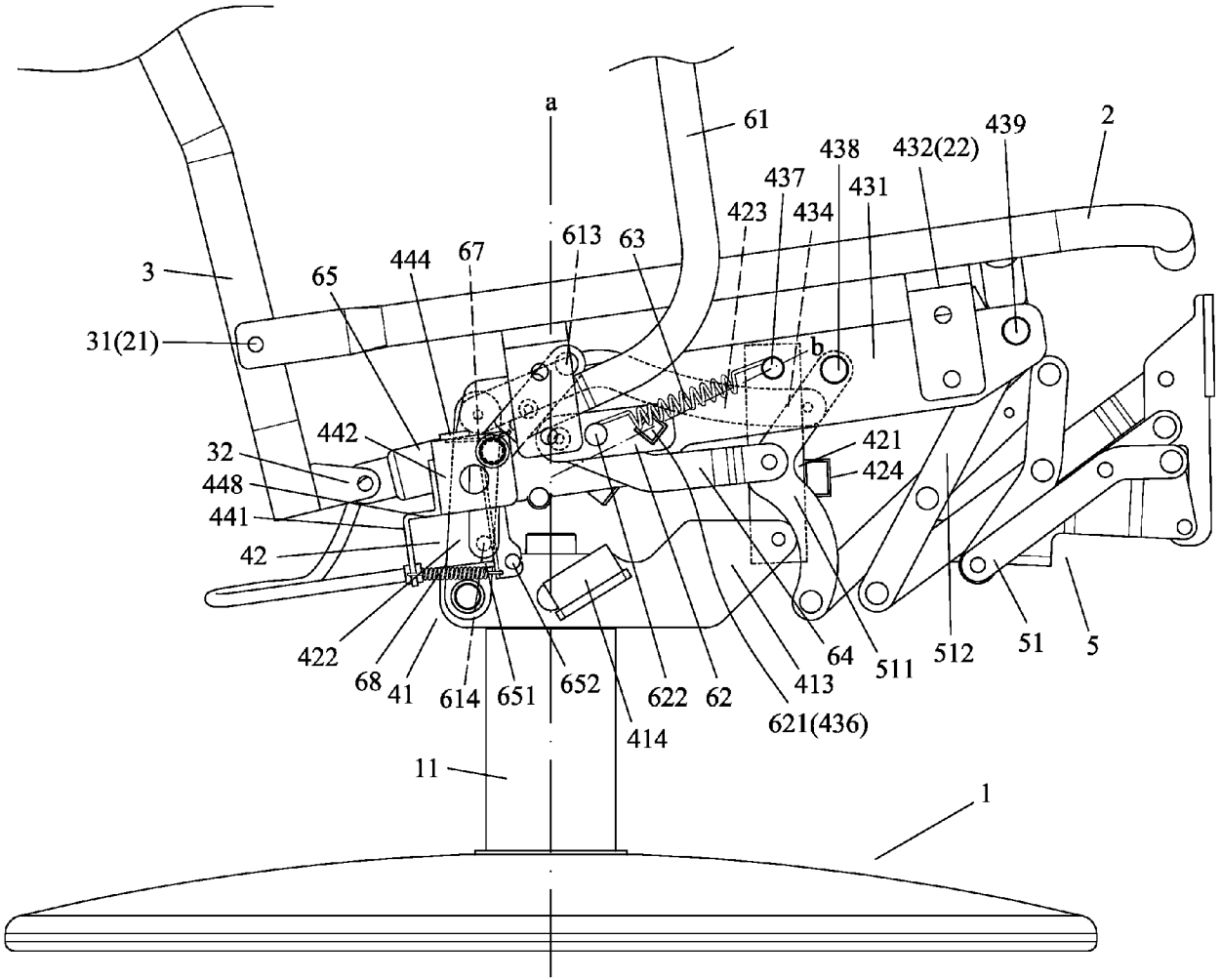
FIG. 4 is a partial, side view of the chair according to the present invention in the sitting position.

With reference to FIGS. 1-4, a leisure chair according to the present invention includes a base 1, a seat 2, a backrest 3, a connection seat 4, a legrest unit 5, and an adjusting unit 6. The base 1 is adapted to be placed on a ground and includes an upper end having a supporting portion 11. The supporting portion 11 has a central supporting axis a.

The seat 2 is mounted on the upper end of the base 1. The seat 2 includes a first pivotal portion 21 at a rear end thereof and a first engagement portion 22 at each of two sides thereof. The seat 2 further includes a transverse rod 23 at a front end thereof. The transverse rod 23 includes a second pivotal portion 24 at an intermediate portion thereof.

The backrest 3 includes two sides. A third pivotal portion 31 is provided at a lower end of each side of the backrest 3 and is pivotably connected to the first pivotal portion 21 of the seat 2. The backrest 3 further includes a lower end having an intermediate portion with a fourth pivotal portion 32.

The connection seat 4 is mounted between the base 1 and the seat 2 and includes a lower coupling portion 41, two pivotal rod units 42, and an upper coupling portion 43. The lower coupling portion 41 is coupled with the supporting portion 11 of the base 1. The lower coupling portion 41 includes a transverse rod 411 having an intermediate portion with an engagement hole 412 coupled with an upper end of the supporting portion 11. A lower coupling plate 413 is provided at each of two sides of the lower coupling portion 41 and extends in a front/back direction of the seat 2. Each of the two lower coupling plates 413 further includes a soft buffering member 414 mounted to an outer side thereof.

Each of the two pivotal rod units 42 is pivotably connected to and movable relative to one of the lower coupling plates 413. Each of the two pivotal rod units 42 includes a front, vertical pivotal rod 421 substantially extending perpendicularly to the ground, a rear, vertical pivotal rod 422 substantially extending perpendicularly to the ground, and a connecting rod 423 extending in the front/back direction of the seat 2. The front, vertical pivotal rod 421 of each of the two pivotal rod units 42 has a lower end pivotably connected to a front end of one of the two lower coupling plates 413. The rear, vertical pivotal rod 422 of each of the two pivotal rod units 42 has a lower end pivotably connected to a rear end of one of the two lower coupling plates 413. A transverse rod 424 is interconnected between the two front, vertical pivotal rods 421 to provide enhanced assembling stability. The connecting rod 423 of each of the two pivotal rod units 42 has a rear end pivotably connected to an upper end of one of the rear, vertical pivotal rods 422. The connecting rod 423 of each of the two pivotal rod units 42 further includes a front end located in front of a front end of one of the front, vertical pivotal rods 421.

The upper coupling portion 43 includes two upper coupling plates 431 extending in the front/back direction of the seat 2. Each of the two upper coupling plates 431 includes a second engagement portion 432 fixed to one of the first engagement portions 22 of the first the seat 2. A transverse rod 433 is interconnected between the two upper coupling plates 431 to provide enhanced assembling stability. Each of the two upper coupling plates 431 further includes an intermediate portion having a fifth pivotal portion 434 pivotably connected to the upper end of one of the front, vertical pivotal rods 421. Each of the two upper coupling plates 431 includes a through-hole 435. A transverse connecting beam 436 is coupled in and extends through the through-holes 435 of the two upper coupling plates 431. A protrusion 437 is provided on an outer side of each of the two upper coupling plates 431. The front end of each of the two upper coupling plates 431 includes two front pivotal portions 438 and 439.

A side coupling portion 44 is mounted to the outer side of one of the two upper coupling plates 431. The side coupling portion 44 includes a rear board 441, an outer board 442, an inner board 443, and a top board 444. The side coupling portion 44 defines a chamber 445 in a central portion thereof. The inner board 443 is fixed to the one of the two upper coupling plates 443 and has an axle 446. The rear board 441 includes a lower end having a guiding hole 447. The rear board 441 further includes an intermediate section having a bend with an abutment portion 448 (see FIG. 4).

The legrest unit 5 includes two link units 51 movable between an extended position and a folded position. A rear end of each of the two link units 51 is pivotably connected to one of the upper coupling plates 431 and includes first and second links 511 and 512 pivotably connected to the two front pivotal portions 438 and 439, respectively. Each first link 511 is located behind an associated one of the second links 512 and is pivotably connected with the front end of one of the connecting rods 423.

The adjusting unit 6 includes a control rod 61, two swaying rods 62, two first springs 63, a driving rod 64, a pneumatic rod 65, a pull rod 66, a second spring 67, and a third spring 68. The control rod 61 includes a gripping portion 611 at an upper end thereof. The control rod 61 further includes a lower end in the chamber 445 of the side coupling portion 44. The control rod 61 further includes a sixth pivotal portion 612 pivotably connected to the axle 446 of the side coupling portion 44. The control rod 61 further includes a pressing portion 613 and a push portion 614 above and below the sixth pivotal portion 612, respectively.

Each of the two swaying rods 62 is mounted to the outer side of one of the upper coupling plates 431. Each of the two swaying rods 62 includes a front end having an engagement hole 621. The transverse connecting beam 436 of the connection seat 4 is securely engaged in the engagement holes 621 of the two swaying rods 62, such that the transverse connecting beam 436 and the two swaying rods 62 are jointly moveable. A rear end of each of the two swaying rods 62 is pivotably connected to a rear end of the driving rod 64. Each of the two swaying rods 62 further includes an intermediate portion having a peg 622.

A first end of each of the two first springs 63 is attached to the peg 622 of one of the two swaying rods 62. A second end of each of the two first springs 63 is attached to the protrusion 437 of one of the two upper coupling plates 431. An imaginary line b extends through the engagement hole 621 of each of the two swaying rods 62 and the protrusion 437 of one of the two upper coupling plates 431. The rear end of the driving rod 64 is pivotably connected to the two swaying rods 62. The driving rod 64 further includes a front end pivotably connected to the first link 511 of one of the two link units 51. The driving rod 64 can actuate the legrest unit 5, the two pivotal rod units 42, and the upper coupling portion 43 to move.

The pneumatic rod 65 can retain the backrest 3 in a desired rearward inclination angle relative to the seat 2. The pneumatic rod 65 includes a rear end pivotably connected to the fourth pivotal portion 32 of the backrest 3 and a front end pivotably connected to the second pivotal portion 24 of the seat 2. The pneumatic rod 65 further includes a control cable 651 extending through the guiding hole 447 of the side coupling portion 44. The pneumatic rod 65 further includes an end 652.

The pull rod 66 is mounted in the chamber 445 of the side coupling portion 44. The pull rod 66 includes an upper end pivotably connected to the axle 446 and a lower end coupled to the end 652 of the pneumatic rod 65. The push portion 614 can actuate the pull rod 66 to move and to extend the control cable 651 of the pneumatic rod 65.

The second spring 67 is a torsion spring mounted around the axle 446. The second springs 67 includes two ends respectively attached to the control rod 61 and the side coupling portion 44.

The third spring 68 has two ends respectively attached to the rear board 441 of the side coupling portion 44 and the pull rod 66. When the pull rod 66 moves, the third spring 68 is tensioned for returning the pull rod 66.

When the legrest unit 5 is in the storage position, the upper coupling portion 43 of the connection seat 4 is substantially in a position corresponding to the central supporting axis a. When the legrest unit 5 is pulled by the first springs 63 and is retained in the storage position, the pegs 622 of the two swaying rods 62 are located above the imaginary lines b, and the control rod 61 is positioned by the second spring 67.

Figure 5:
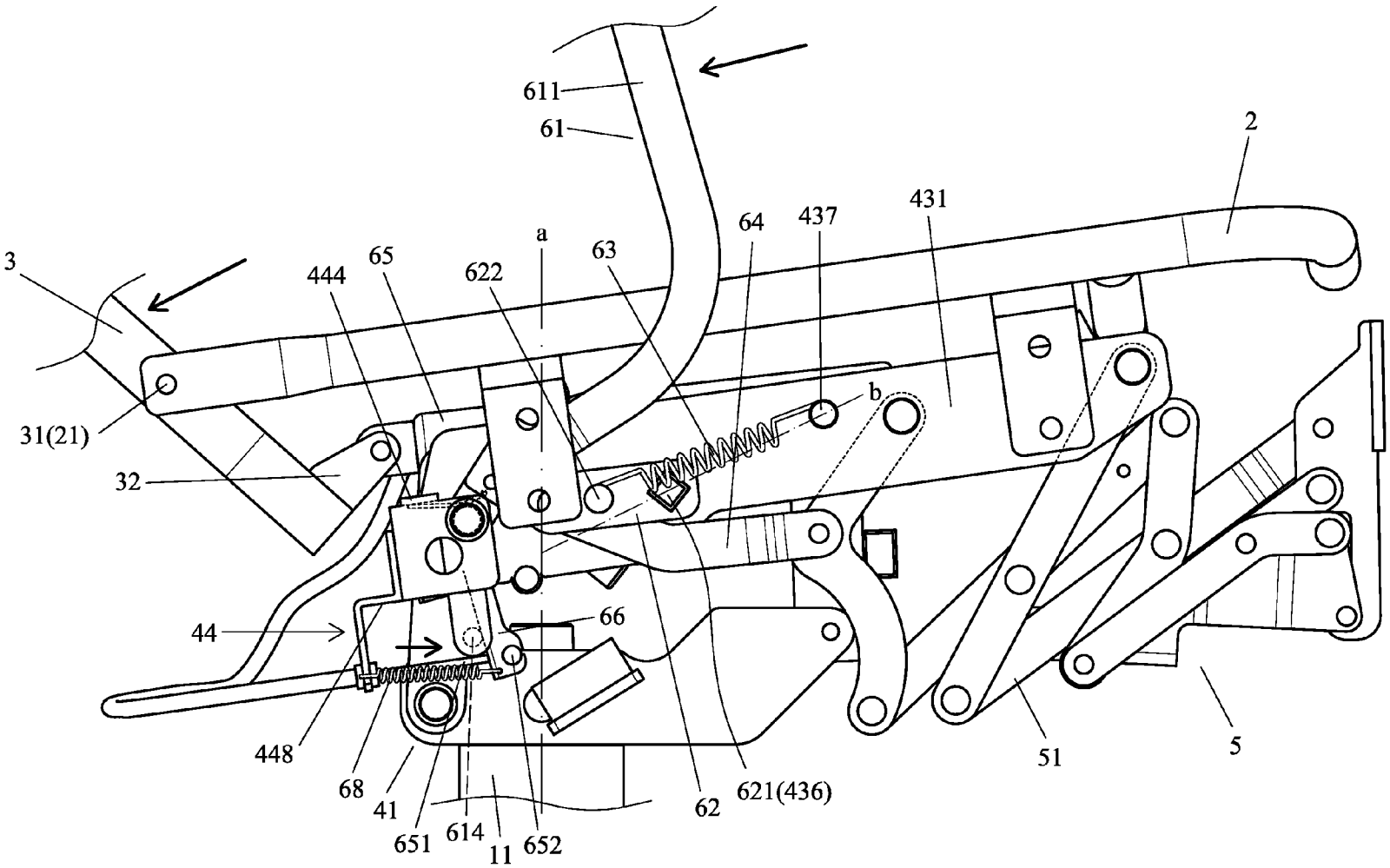
FIG. 5 is an enlarged view of the chair in FIG. 4, with a control rod moved rearwards to cause rearward inclination of a backrest of the chair.

When a user intends to lie rearwards (see FIG. 5), the user can pull the control rod 61 rearward by the gripping portion 611, the push portion 614 moves and pulls the control cable 651 of the pneumatic rod 65, such that the pneumatic rod 65 telescopes. When the control rod 61 is released (FIG. 8), the control cable 651 is not subject to force, such that the pneumatic rod 65 maintains its length after adjustment, and the rearward inclination angle of the backrest 3 is fixed. Furthermore, the control rod 61 can return to its original position under the action of the third spring 68.

Figure 6:
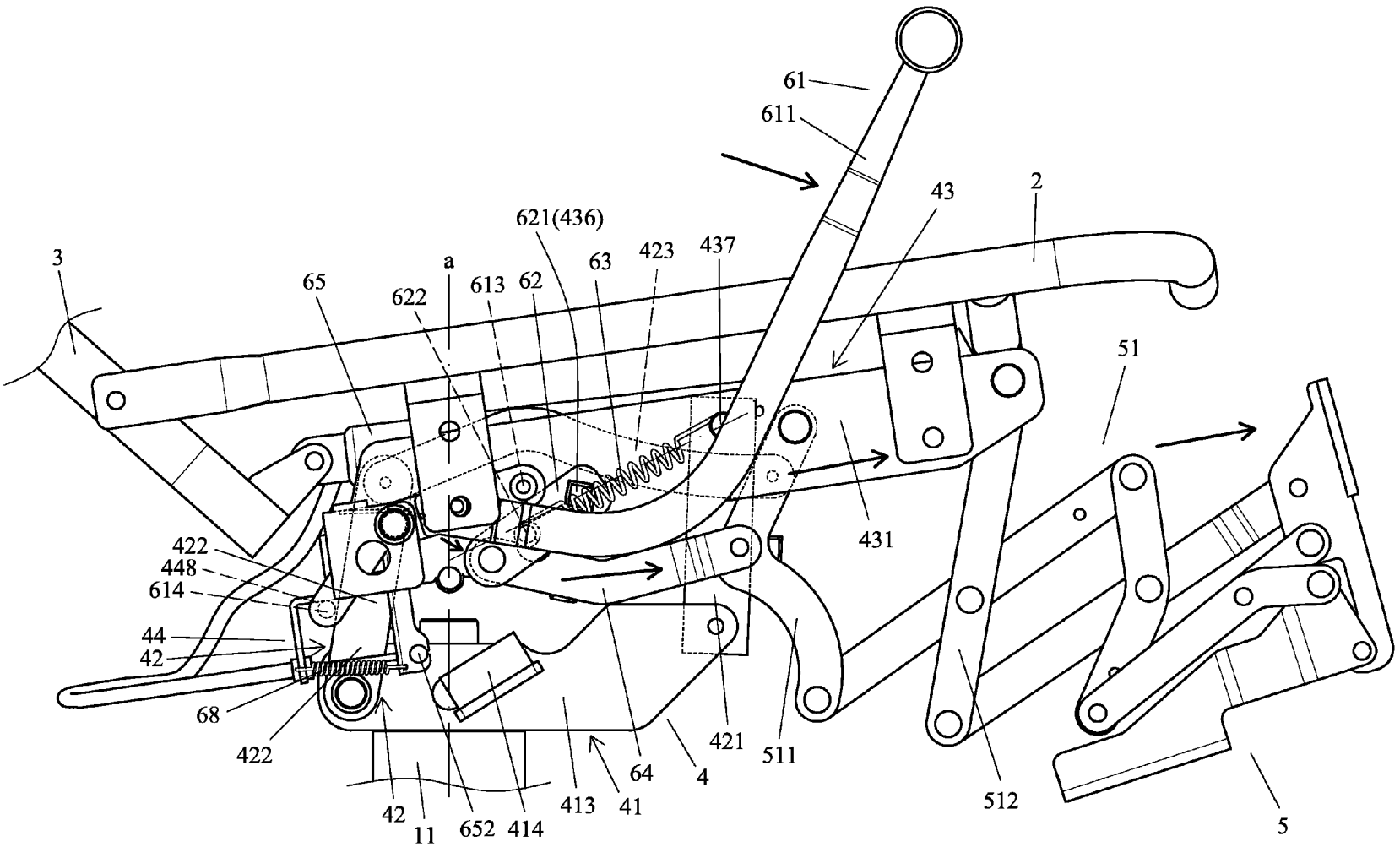
FIG. 6 is a view similar to FIG. 5, with the control rod moved forwards to extend a legrest unit of the chair.
Figure 7:
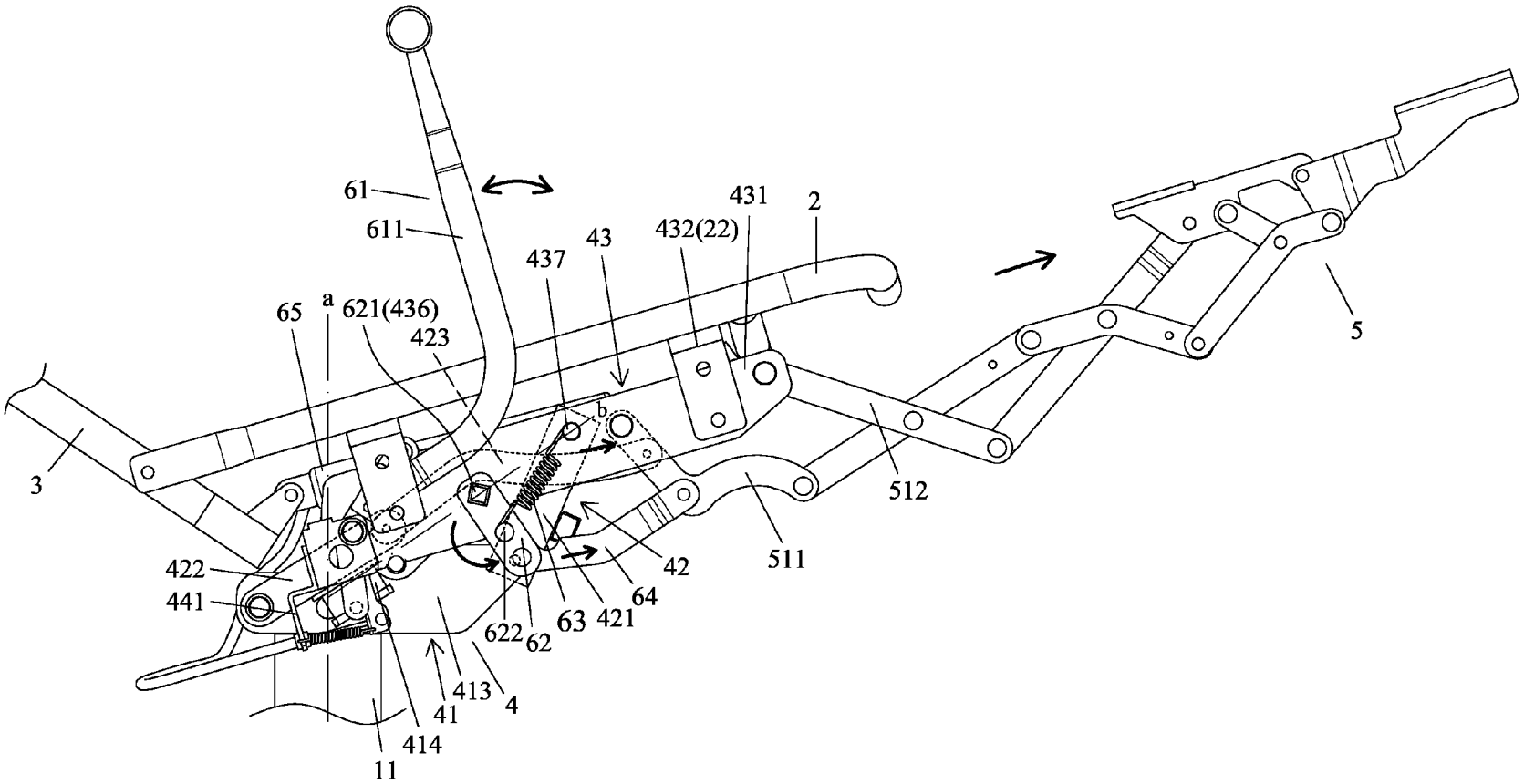
FIG. 7 is a view similar to FIG. 6, with the legrest unit extended and with an upper coupling portion moved forwards.
Figure 8:
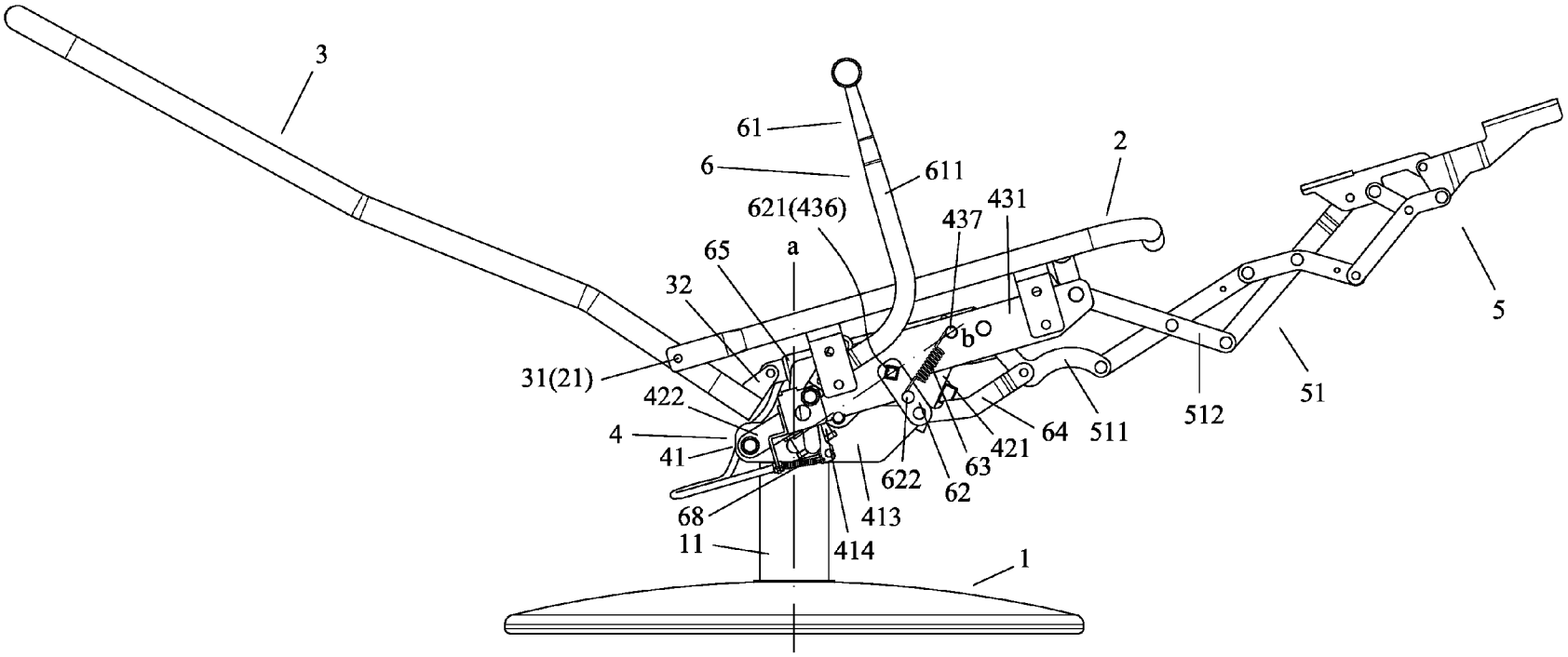
FIG. 8 is a side view of the chair according to the present invention, with the backrest inclined rearwards and with the legrest unit extended.

With reference to FIGS. 6-8, when the driving rod 64 moves forwards, the two link units 51 move to the extended position. Furthermore, when the control rod 61 moves forwards, the pressing portion 613 abuts the two swaying rods 62, and the push portion 614 of the control rod 61 abuts the abutment portion 448 of the side coupling portion 44 to limit a maximum displacement angle of the control rod 61 in the forward direction. Furthermore, the two swaying rods 62 move synchronously. When the peg 622 of each of the two swaying rods 622 moves in the counterclockwise direction to a position on one of the imaginary lines b, the first springs 63 are tensioned to the maximum length. Next, the push portion 614 further moves the two swaying rods 62. When the pegs 622 of each of the two swaying rods 62 are below the imaginary lines, the two pivotal rod units 51 of the legrest unit 5 move to the extended position under the elastic force of the first springs 63. When the legrest unit 5 is in the extended position, the first links 511 of the two link units 51 actuate the connecting rods 423 of the two pivotal rod units 42 of the connection seat 4 to move forward, such that the front, vertical pivotal rods 421 of the two pivotal rod units 42 move forwards. The rear, vertical pivotal rods 422 abuts the soft buffering members 414 during movement of the rear, vertical pivotal rods 422, reducing the noise resulting from impact. Furthermore, since the backrest 3 is pivotably connected to the seat 2, the upper coupling portion 43 can move forwards relative to the lower coupling portion 41, and the center of gravity of the upper coupling portion 42 can be located in front of the central supporting axis a. Thus, when the user lies down, the center of gravity of the upper coupling portion 43 of the connection seat 4 moves forwards to counterbalance the rearward lying force imparted to the backrest 3 while providing enhanced lying stability.

When the legrest 5 has reached the extended position, the control rod 61 is released and is returned to its original position under the elastic force of the second spring 67. When it is desired to move the legrest unit 5 to the storage position, a force can be applied to the legrest unit 5 in the direction for moving the legrest unit 5 to the storage position until the pegs 622 of the two swaying rods 62 are located above the imaginary lines b.

The pneumatic rod 65 and the two first springs 63 can use an electrical mechanical mechanism as the power source, though the costs are increased and electricity is required.

Although specific embodiments have been illustrated and described, numerous modifications and variations are still possible without departing from the scope of the invention. The scope of the invention is limited by the accompanying claims.

The invention claimed is:

1. A leisure chair comprising:

a base adapted to be placed on a ground, with the base including an upper end having a supporting portion, with the base further including a rear end;

a seat mounted on the upper end of the base;

a backrest including a lower end pivotably connected to the rear end of the seat, with the backrest having a rearward inclination angle relative to the seat, with the rearward inclination angle being adjustable;

a connection seat mounted between the base and the seat, with the connection seat including a lower coupling portion, two pivotal rod units, and an upper coupling portion, with the lower coupling portion coupled with the supporting portion of the base, with the lower coupling portion including two sides, with a lower coupling plate provided at each of the two sides of the lower coupling portion and extending in a front/back direction of the seat, with each of the two pivotal rod units pivotably connected to and movable relative to one of the lower coupling plates, with each of the two pivotal rod units including a front, vertical pivotal rod substantially extending perpendicularly to the ground, a rear, vertical pivotal rod substantially extending perpendicularly to the ground, and a connecting rod extending in the front/back direction of the seat, with the front, vertical pivotal rod of each of the two pivotal rod units having a lower end pivotably connected to a front end of the lower coupling plate, with the rear, vertical pivotal rod of each of the two pivotal rod units having a lower end pivotably connected to a rear end of one of the two lower coupling plates, with the connecting rod of each of the two pivotal rod units having a rear end pivotably connected to an upper end of one of the rear, vertical pivotal rods, with the connecting rod of each of the two pivotal rod units further having a front end located in front of a front end of one of the front, vertical pivotal rods, with the upper coupling portion including two upper coupling plates extending in the front/back direction of the seat, with the two upper coupling plates fixed to the seat, with each of the two upper coupling plates pivotably connected to the upper end of the front, vertical pivotal rod of one of the two pivotal rod units;

a legrest unit including two link units movable between an extended position and a folded position, with each of the two link units including a rear end pivotably connected to the front end of one of the upper coupling plates and one of the connecting rods;

an adjusting unit including a driving rod pivotably connected to a rear end of the legrest unit, wherein when the driving rod moves forwards, the two link units move to the extended position, the connecting rods are actuated to move the two link units, and the upper coupling portion moves forwards relative to the lower coupling portion.

2. The leisure chair as claimed in claim 1, with the front end of each of the two upper coupling plates including two front pivotal portions, with the rear end of each of the two link units including first and second links pivotably connected to the two front pivotal portions, respectively, with the first link located behind the second link and pivotably connected with the front end of one of the connecting rods.

3. The leisure chair as claimed in claim 2, with each of the two upper coupling plates including a through-hole, with a transverse connecting beam coupled in and extending through the through-holes of the two upper coupling plates, with a side coupling portion mounted to an outer side of one of the two upper coupling plates and having an axle, with the adjusting unit further including a control rod, two swaying rods, and two first springs, with the control rod including an upper end having a gripping portion and a lower end having a pivotal portion pivotably connected to the axle of the side coupling portion, with the control rod including a pressing portion above the pivotal portion thereof, with each of the two swaying rods mounted to the outer side of one of the upper coupling plates, with each of the two swaying rods including a front end having an engagement hole and a rear end, with the transverse connecting beam of the connection seat securely engaged in the engagement holes of the two swaying rods, with the transverse connecting beam and the two swaying rods jointly moveable, with the rear end of each of the two swaying rods pivotably connected to a rear end of the driving rod, with each of the two swaying rods further including an intermediate portion having a peg, with each of two first springs having first and second ends, with the first end of each of the two first springs attached to the peg of one of the two swaying rods, with the second end of each of the two first springs attached to a protrusion of one of the two upper coupling plates, with an imaginary line extending through the engagement hole of each of the two swaying rods and the protrusion of one of the two upper coupling plates, with the rear end of the driving rod pivotably connected to the two swaying rods, with the driving rod further including a front end pivotably connected to the first link of one of the two link units, wherein when the legrest unit is in the storage position, the pegs of the two swaying rods located above the imaginary lines, and wherein when the control rod moves forwards, the pressing portion presses against and actuates the two swaying rods to move, and the legrest unit moves to the extended position under elastic forces provided by the first springs when the pegs of the two swaying rods located below the imaginary lines.

4. The leisure chair as claimed in claim 3, with the adjusting unit further including a second spring attached between the control rod and the side coupling portion.

5. The leisure chair as claimed in claim 4, with the side coupling portion including a rear board having an intermediate section with a bend, with the bend of the intermediate section of the rear board having an abutment portion, with the control rod including a push portion, and with the push portion of the control rod abutting the abutment portion to limit a maximum displacement angle of the control rod.

6. The leisure chair as claimed in claim 3, further comprising a transverse rod interconnected between the two front, vertical pivotal rods and a transverse rod interconnected between the two upper coupling plates.

7. The leisure chair as claimed in claim 3, with each of the two lower coupling plates of the connection seat further including a soft buffering member mounted to an outer side thereof, and with the rear, vertical pivotal rods abutting the soft buffering members during movement of the rear, vertical pivotal rods.

8. The leisure chair as claimed in claim 3, with the side coupling portion including a rear board, with the adjusting unit further including a pneumatic rod and a pull rod, with the rear board of the side coupling portion including a lower end having a guiding hole, with the control rod further including a push portion below the pivotal portion thereof, with the pneumatic rod including a rear end pivotably connected to the backrest and a front end pivotably connected to the seat, with the pneumatic rod further including a control cable extending through the guiding hole of the side coupling portion, with the pneumatic rod further including an end, with the pull rod including an upper end pivotably connected to the axle and a lower end coupled to the end of the pneumatic rod, wherein when the control rod moves rearwards, the push portion actuates the pull rod to move and pull the control cable of the pneumatic rod.

9. The leisure chair as claimed in claim 8, with the adjusting unit further including a third spring having two ends respectively attached to the rear board of the side coupling portion and the pull rod, wherein when the pull rod moves, the third spring is tensioned for returning the pull rod.

* * * * *